US007260888B2

(12) United States Patent
Hsu et al.

(10) Patent No.: US 7,260,888 B2
(45) Date of Patent: Aug. 28, 2007

(54) FABRICATING METHOD OF KEYPAD ASSEMBLY

(75) Inventors: Ming-Yuan Hsu, Taipei County (TW); Dean-Kuo Liu, Taoyuan County (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/163,983

(22) Filed: Nov. 7, 2005

(65) Prior Publication Data

US 2007/0029183 A1 Feb. 8, 2007

(30) Foreign Application Priority Data

Aug. 4, 2005 (TW) ..... 94126490 A

(51) Int. Cl.
*H01H 11/00* (2006.01)
*H01H 13/14* (2006.01)

(52) U.S. Cl. ..... 29/622; 29/832; 29/834; 29/835; 29/846; 29/847; 200/520

(58) Field of Classification Search ..... 29/831, 29/832, 834, 835, 830, 847, 846, 622, 842; 438/161, 155, 156; 430/5, 22, 196; 257/81, 257/59, 72, 92; 200/520, 530, 50.08, 50.02
See application file for complete search history.

(56) References Cited

U.S. PATENT DOCUMENTS 5,844,166 A * 12/1998 Halttunen et al. ..... 174/381
6,284,414 B1 * 9/2001 Okamoto ..... 430/5
6,492,678 B1 * 12/2002 Hebert ..... 257/331
6,528,824 B2 * 3/2003 Yamagata et al. ..... 257/81

* cited by examiner

*Primary Examiner*—A. Dexter Tugbang
*Assistant Examiner*—Tai Van Nguyen
(74) *Attorney, Agent, or Firm*—Jianq Chyun IP Office

(57) ABSTRACT

A keypad assembly including a substrate, a metal layer, a patterned light-shielding layer, a light-transparent material layer and a keypad circuit module is provided. Said substrate has a first surface and a second surface and the metal layer is disposed on the first surface of the substrate. In addition, the patterned light-shielding layer is disposed on the metal layer to define a light-transparent area and a light-shielding area, wherein the patterned light-shielding layer corresponds to the light-transparent area. In the meantime, the light-transparent material layer is disposed on the second surface of the substrate and corresponds to the light-transparent area. Further, the keypad circuit module is disposed on the patterned light-shielding layer.

6 Claims, 3 Drawing Sheets

FABRICATING METHOD OF KEYPAD ASSEMBLY

CROSS-REFERENCE TO RELATED APPLICATION

This application claims the priority benefit of Taiwan application Ser. No. 94126490, filed on Aug. 4, 2005. All disclosure of the Taiwan application is incorporated herein by reference.

BACKGROUND OF THE INVENTION

1. Field of Invention

The present invention relates to a keypad assembly and a fabricating method thereof, particularly to a portable electronic device with slimmer keypad assembly, and fabricating method thereof.

2. Description of the Related Art

Along with the advancement of technology and the rising demand for conveniently in consumer electronic market, the major design requirements for portable electronic devices currently focus on slim size, lightweight and enhanced functions. In general, portable electronic devices, especially referring to hand-held electronic devices, are categorized into cell phones, electronic dictionaries and translators, PDAs (personal digital assistants) and hand-held gaming machines.

Take the cell phone for example. A cell phone mainly includes a main body, a display unit and a keypad assembly wherein, the main body comprises a data processing module and the display unit usually is a liquid crystal display module (LCM) disposed inside the main body. The display area of the display unit is disposed outside the main body and used for displaying images, pictures and words. In addition, a keypad assembly is usually disposed on the main body and serves as user interface for the portable electronic device.

The conventional way of fabricating keypad assembly, generally involves the injection molding process of a blank keypad base with thermoplastic material, such as plastic or rubber. Additionally, the blank keypad base is in the jet coating and laser etching process for desired appearance. Lastly, the blank keypad base is assembled with the main body, so that the keypad assembly can function as controller of the portable electronic device. In the current market, many portable electronic devices with a surface focusing on metallic texture have become popular. In consideration of overall consistent structure, the surfaces of the most keypad assemblies are designed with metallic texture. Hence, the surfaces of conventional blank keypad bases are usually jet-coated with metal paint, or pressed with metal plates in thermal pressing technology.

In view of the foregoing, the injection molding process of making the blank keypad bases requires expensive equipment investment; however, the thickness of a portable electronic device as a whole cannot be effectively trimmed down because a metal plate is required to be fitting jointly in the keypad base. In addition, pressing the jointed metal plate onto the keypad assembly can easily destroy the integrity of the jointed metal plate. Therefore, the production cost is unable to be scaled down and the production yield of the product cannot be effectively increased

SUMMARY OF THE INVENTION

In view of the foregoing, an objective of the present invention is to provide a keypad assembly with metallic texture and slim thickness.

Another objective of the present invention is to provide a fabricating method of a keypad assembly capable to effectively save production cost.

To achieve objectives above or others, the present invention provides a keypad assembly, which includes a substrate, a metal layer, a patterned light-shielding layer, a light-transparent material layer and a keypad circuit module. Said substrate has a first surface and a second surface, and the metal layer is disposed on the first surface of the substrate. In addition, the patterned light-shielding layer is disposed on the metal layer to define a light-transparent area and a light-shielding area, wherein the patterned light-shielding layer corresponds to the light-shielding area, while the light-transparent material layer is disposed on the second surface of the substrate and corresponds to the light-transparent area. Additionally, the keypad circuit module is disposed on the patterned light-shielding layer.

In an embodiment of the present invention, the material of the substrate includes polycarbonate (PC), polyethylene tereph-thalate (PET), polymethylmethacrylate (PMMA), acrylonitrile-butadiene-styrene copolymers (ABS) or a combination of PC and ABS (PC+ABS).

In an embodiment of the present invention, the patterned light-shielding layer and light-transparent material layer use the printing ink and resin materials, respectively.

In an embodiment of the present invention, the keypad circuit module includes a plate and a circuit board wherein the plate disposed on the patterned light-shielding layer has a plurality of protrusions corresponding to the light-transparent area. The circuit board, disposed on the plate, has a plurality of conductive elastic pads corresponding to the protrusions.

In an embodiment of the present invention, the keypad circuit module includes a planar light source, a plate and a circuit board wherein the planar light source is disposed on the patterned light-shielding layer and, for instance, is an inorganic electroluminescent device, an organic electroluminescent device, a flexible inorganic electroluminescent device or a flexible organic electroluminescent device. The plate, disposed on the planar light source having a plurality of protrusions corresponding to the light-transparent area is made of materials of polycarbonate (PC), polyethylene tereph-thalate (PET), polymethylmethacrylate (PMMA), acrylonitrile-butadiene-styrene copolymers (ABS), a combination of PC and ABS (PC+ABS), silicone rubber, poly urethanes (PU), thermoplastic rubber (TPR) or thermoplastic urethanes (TPU). The circuit board is disposed on the plate and has a plurality of conductive elastic pads corresponding to the protrusions.

The keypad assembly of the present invention is generally very thin and the fabricating method thereof can save production cost.

To achieve the above-described objects or others, the present invention further provides a fabricating method of a keypad assembly, including the following steps. First, a substrate comprising a first surface and a second surface, and a metal layer formed on the first surface of said substrate is provided. Additionally, a patterned light-shielding layer is formed on the metal layer to define a light-transparent area and a light-shielding area, wherein the patterned light-shielding layer corresponds to the light-shielding area. Furthermore, a keypad circuit module is provided and the keypad circuit module is assembled onto the patterned light-shielding layer.

In an embodiment of the present invention, the method for forming a metal layer includes vapor deposition, sputtering or a combination thereof.

In an embodiment of the present invention, the method for forming a patterned light-shielding layer includes screen-printing or ink injecting.

In an embodiment of the present invention, the method for forming a light-transparent material layer includes screen-printing.

In an embodiment of the present invention, the method for assembling a keypad circuit module onto the patterned light-shielding layer includes the following steps. First, a plate is assembled onto the patterned light-shielding layer, wherein the plate has a plurality of protrusions corresponding to the light-transparent area. Additionally, a circuit board is assembled onto the plate, wherein the circuit board has a plurality of conductive elastic pads corresponding to the protrusions.

In an embodiment of the present invention, the method for assembling the keypad circuit module onto the patterned light-shielding layer includes the following steps. First, a planar light source is assembled onto the patterned light-shielding layer. Additionally, a plate is assembled onto the planar light source, wherein the plate has a plurality of protrusions corresponding to the light-transparent area. Lastly, a circuit board is assembled onto the plate, wherein the circuit board has a plurality of conductive elastic pads corresponding to the protrusions.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

Figure 1:
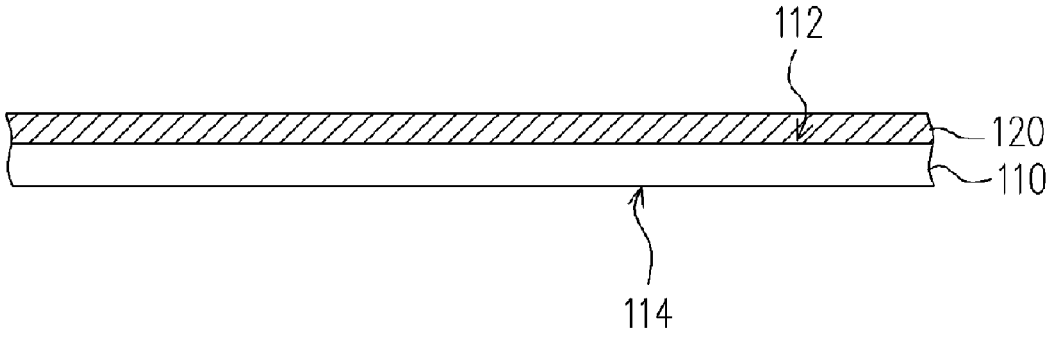
FIG. 1 to FIG. 5 are schematic flow charts of fabricating a portable electronic device.

FIG. 1 to FIG. 5 are schematic flow charts of fabricating a portable electronic device. Referring to FIG. 1, a substrate 110 is provided. The substrate 110 has a first surface 112 and a second surface 114, and on the first surface 112 of the substrate 110, a metal layer 120 is formed. In the embodiment, the substrate 110 can be made of, polycarbonate (PC), polyethylene tereph-thalate (PET), polymethylmethacrylate (PMMA), acrylonitrile-butadiene-styrene copolymers (ABS) or a combination of PC and ABS (PC+ABS). Methods for forming the metal layer 120 can be, vapor deposition, sputtering or a combination of the two methods thereof.

Figure 2:
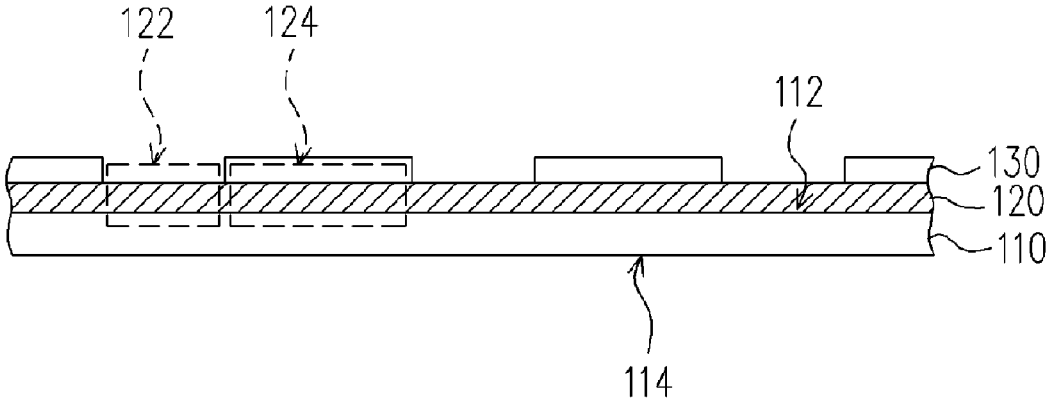

Additionally, referring to FIG. 2, a patterned light-shielding layer 130 is formed on the metal layer 120 to define a light-transparent area 122 and a light-shielding area 124, wherein the patterned light-shielding layer 130 corresponds to the light-shielding area 124. In the embodiment, the method for forming the patterned light-shielding layer 130 includes screen-printing or ink injecting to print ink on the metal layer 120. Essentially, other processing methods used in the present invention are applicable for fabricating the patterned light-shielding layer 130.

Figure 3:
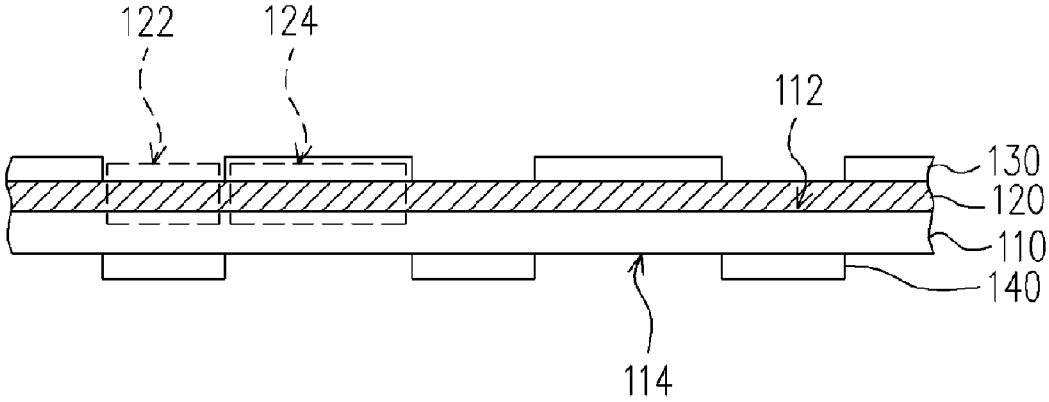

In addition to FIG. 3, a light-transparent material layer 140 is formed on the second surface 114 of the substrate 110, wherein the light-transparent material layer 140 corresponds to the light-transparent area 122. In the embodiment, the method for forming the light-transparent material layer 140 is screen-printing, for instance, for to print resin onto the second surface 114 of the substrate 110. Essentially, other processing methods used in the present invention are applicable for fabricating the light-transparent material layer 140.

Figure 4:
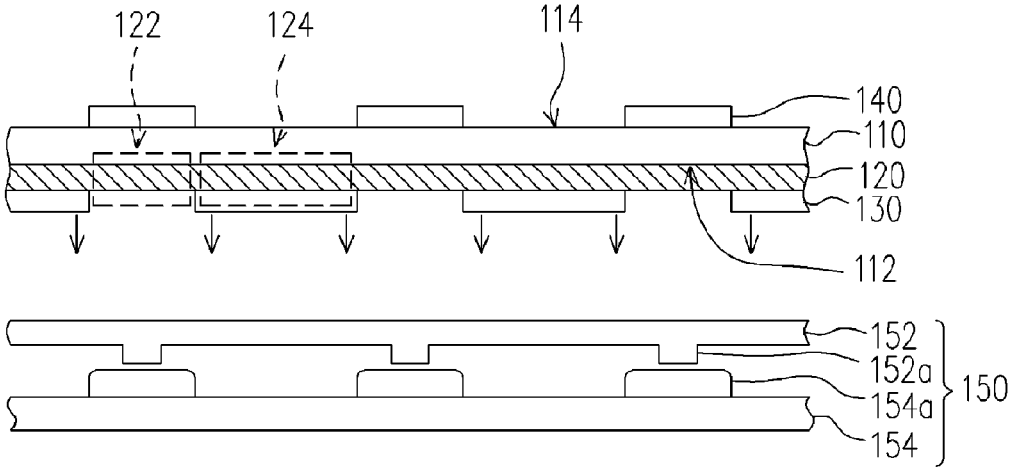

In addition to FIG. 4, a keypad circuit module 150 is provided with assembling onto the patterned light-shielding layer 130. In the embodiment, the keypad circuit module 150 comprises a plate 152 and a circuit board 154. Hence, the method to assemble the keypad circuit module 150 onto the patterned light-shielding layer 130 includes the following steps. First, a plate 152 is disposed on the patterned light-shielding layer 130 using closely fitted adhering. Said plate 152 has a plurality of protrusions 152*a* corresponding to the light-transparent area 122, respectively. Additionally, the circuit board 154 is assembled onto the plate 152, and the circuit board 154 has a plurality of conductive elastic pads 154*a* corresponding to the protrusions 152*a*, respectively. In the embodiment, the plate 152 is made of polycarbonate (PC), polyethylene tereph-thalate (PET), polymethylmethacrylate (PMMA), acrylonitrile-butadiene-styrene copolymers (ABS), a combination of PC and ABS (PC+ABS), silicone rubber, poly urethanes (PU), thermoplastic rubber (TPR) or thermoplastic urethanes (TPU).

Figure 5:
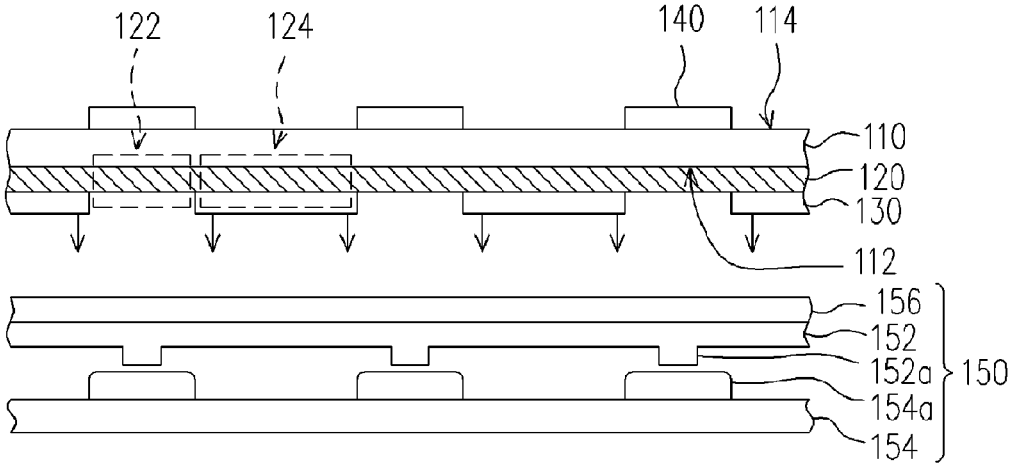

Lastly, FIG. 5 is a diagram of a keypad assembly having a planar light source. In the embodiment, for identifying the figures or the texts on the keypad assembly 100 (also referring to FIG. 6) in an environment without sufficient light source, the present invention further assembles a planar light source 156 onto the patterned light-shielding layer 130, followed by assembling the plate 152 onto the planar light source 156 for increasing the identification of the keypad. As discussed above, the plate 152 and the planar light source 156 are assembled together through an adhering layer with a closely fitted adhering. In the embodiment, the planar light source 156 serves as luminescent devices capable of electricity saving, such as: inorganic electroluminescent device, a organic electroluminescent device, flexible inorganic electroluminescent device or flexible organic electroluminescent device.

As shown in FIGS. 4 and 5, the keypad circuit module 150 does not necessarily include the planar light source 156, but other point-like light sources, such as: a diode component can be used. Additionally, in the keypad circuit module 150 discussed above, the position to dispose the light source can be changed. In this case, the light source can be disposed on the circuit board 154 or at other appropriate locations.

Figure 6:
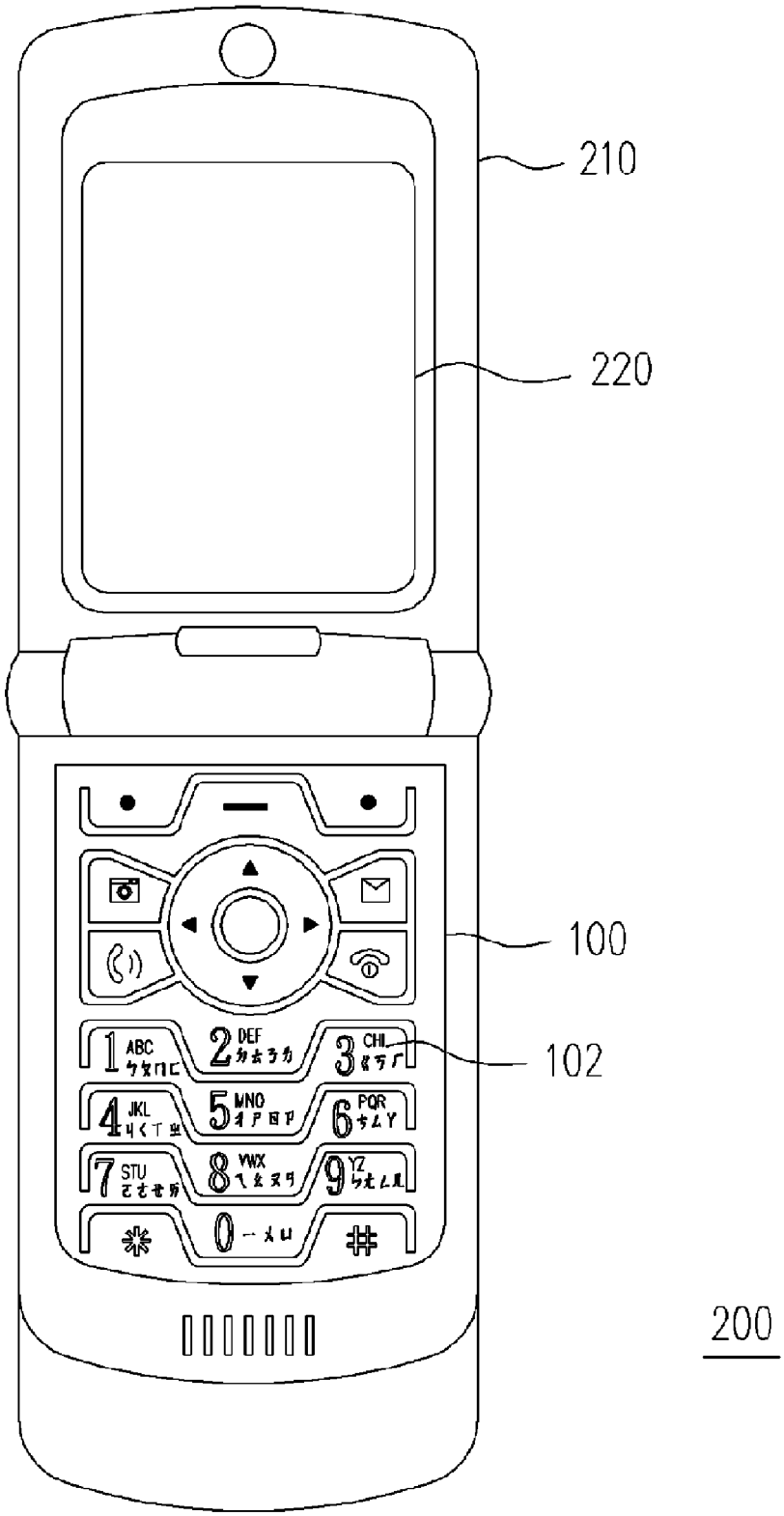
FIG. 6 is a diagram of a portable electronic device using a keypad assembly of the present invention.

FIG. 6 is a diagram of a portable electronic device using a keypad assembly of the present invention. Referring to FIGS. 5 and 6, a portable electronic device 200 includes a main body 210, a display unit 220 and a keypad assembly 100 wherein the main body 210 includes a data-processing module (not shown in the figures) disposed therein, and the data-processing module (not shown in the figures) is electrically connected to the circuit board 154. The display unit 220 is disposed on the main body 210 and has a display area, which is exposed on the surface of the main body 210 for displaying outputs of images, patterns and texts. In addition, the keypad assembly 100 is disposed on the main body 210 and adjacent to the display unit 220.

It is noted that the light-transparent area 122 of the keypad assembly 100 corresponds to a space between any two adjacent keys 102 served for a user to enter data or writing on any key 102. Therefore, as a user presses the keys 102 for entering data into the portable electronic device 200, the protrusions 152*a* inside the keypad assembly 100 would press the conductive elastic pads 154*a* as well for delivering message or signal to the data-processing module (not shown in the figures) via the circuit board 154. Subsequently, the data-processing module (not shown in the figures) of the portable electronic device 200 processes the data entered by the user, and the display area of the display unit 220 displays the processed result.

In short, the keypad assembly and the fabricating method thereof has at least the following advantages:

1. It provides a keypad assembly with lightweight, metallic texture and a thickness less than 0.1 mm for more lightweight and thinner portable electronic device.
2. Expensive equipment, such as an injection molding machine or a thermal presser, is not required. Therefore, the present application not only saves the equipment investment, but also increases production yield.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A fabricating method of a keypad assembly, comprising:

providing a substrate, wherein the substrate has a first surface and a second surface;

forming a metal layer on the first surface of the substrate;

forming a patterned light-shielding layer on the metal layer to define a light-transparent area and a light-shielding area, wherein the patterned light-shielding layer corresponds to the light-shielding area;

forming a light-transparent material layer on the second surface of the substrate, wherein the light-transparent material layer corresponds to the light-transparent area; and providing a keypad circuit module and assembling the keypad circuit module onto the patterned light-shielding layer.

2. The fabricating method of a keypad assembly as recited in claim 1, wherein the method for forming the metal layer comprises vapor deposition, sputtering or a combination thereof.

3. The fabricating method of a keypad assembly as recited in claim 1, wherein the method for forming the patterned light-shielding layer comprises screen-printing or ink injecting.

4. The fabricating method of a keypad assembly as recited in claim 1, wherein the method for forming light-transparent material layer comprises screen-printing.

5. The fabricating method of a keypad assembly as recited in claim 1, wherein the method for assembling the keypad circuit module onto the patterned light-shielding layer comprises:

assembling a plate onto the patterned light-shielding layer, wherein the plate has a plurality of protrusions corresponding to the light-transparent area; and assembling a circuit board onto the plate, wherein the circuit board has a plurality or conductive elastic pads corresponding to the protrusions.

6. The fabricating method of a keypad assembly as recited in claim 1, wherein the method for assembling the keypad circuit module onto the patterned light-shielding layer comprises:

assembling a planar light source onto the patterned light-shielding layer;

assembling a plate onto the planar light source, wherein the plate has a plurality of protrusions corresponding to the light-transparent area; and assembling a circuit board onto the plate, wherein the circuit board has a plurality of conductive elastic pads corresponding to the protrusions.

* * * * *